US007217099B2

(12) United States Patent
Casanova et al.

(10) Patent No.: US 7,217,099 B2
(45) Date of Patent: May 15, 2007

(54) COATED FORWARD STUB SHAFT DOVETAIL SLOT

(75) Inventors: Fernando Jorge Casanova, Simpsonville, SC (US); San-Dar Gau, Greenville, SC (US); Richard Michael Robinson, Simpsonville, SC (US); Raymond Grant Rowe, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 53 days.

(21) Appl. No.: 11/135,470

(22) Filed: May 24, 2005

(65) Prior Publication Data

US 2006/0269415 A1 Nov. 30, 2006

(51) Int. Cl.
*F01D 5/30* (2006.01)

(52) U.S. Cl. ..... 416/219 R; 416/224; 416/241 R; 416/241 A; 416/244 A; 416/248

(58) Field of Classification Search ..... 416/219 R, 416/220 R, 221, 224, 248, 241 R, 241 A, 416/244 A
See application file for complete search history.

(56) References Cited

U.S. PATENT DOCUMENTS 2,994,507 A * 8/1961 Keller et al. ..... 416/221
4,471,008 A * 9/1984 Huther ..... 427/383.5
4,850,187 A * 7/1989 Siga et al. ..... 60/39.37
5,141,401 A 8/1992 Juenger et al.
5,240,375 A 8/1993 Wayte
5,356,545 A 10/1994 Wayte
5,360,318 A * 11/1994 Siga et al. ..... 415/216.1
5,368,444 A * 11/1994 Anderson ..... 416/220 R
5,431,542 A 7/1995 Weisse et al.
5,573,377 A 11/1996 Bond et al.
5,601,933 A * 2/1997 Hajmrle et al. ..... 428/660
6,089,828 A * 7/2000 Hollis et al. ..... 416/219 R
6,267,558 B1 7/2001 Dingwell et al.
6,290,466 B1 9/2001 Ravenhall et al.
6,749,951 B1 6/2004 Darolia et al.
6,751,863 B2 * 6/2004 Tefft ..... 29/889.21

FOREIGN PATENT DOCUMENTS

GB 2171150 A * 8/1986 ..... 416/220 R

* cited by examiner

*Primary Examiner*—Christopher Verdier
(74) *Attorney, Agent, or Firm*—Nixon & Vanderhye P.C.

(57) ABSTRACT

A compressor forward stub shaft comprising a plurality of axially spaced, annular rows of dovetail grooves, at least a first and a second of the plurality of rows having dovetail slots coated in part with an anti-wear coating.

13 Claims, 3 Drawing Sheets

COATED FORWARD STUB SHAFT DOVETAIL SLOT

BACKGROUND OF THE INVENTION

This invention relates generally to rotating machine technology, and specifically, to the mounting of compressor blades in rotor dovetail slots.

Typically, wear coatings are applied to the dovetail portions of compressor blades in order to reduce compressive stresses and wear between the blades and the compressor wheel dovetail slots. Such coatings have been applied to the blade dovetails primarily due to the fact that coatings are easily applied here. In practice, for example, the blade itself is masked, and there is a direct line of sight for spraying the coating on the blade dovetail and if curing is required, the blades can be easily handled and moved through an oven. Some typical wear coatings, however, such as MoS2 and other generally similar coatings, are not compatible with a typical steel C450 alloy used for the blades. In fact, coatings applied to C450 alloy material can degrade the corrosion fatigue resistance of that material.

Accordingly, there remains a need to provide wear resistance between compressor blades and compressor wheel dovetails without jeopardizing the corrosion fatigue resistance of the blade.

BRIEF DESCRIPTION OF THE INVENTION

In the exemplary embodiment of this invention, the wear coating is applied directly onto the compressor wheel dovetail slots in order to minimize, if not eliminate, potential corrosive conditions that could develop between the coatings and the blade material used in certain gas turbines. More specifically, in one exemplary embodiment, an Alumazite-ZD coating is applied directly to the dovetail slots in stages 1 and 2 of the compressor forward stub shaft, where the above noted problem has been identified. This is a particularly advantageous solution since the coating itself is a conventional coating used to reduce wear and crush stresses, and no redesign of any component parts is necessary.

Accordingly, in one aspect, the present invention relates to a compressor forward stub shaft comprising a plurality of axially spaced, annular rows of dovetail grooves, at least a first and a second of the plurality of rows having dovetail slots coated in part with a wear-resistant coating.

In another aspect, the present invention relates to a turbine compressor shaft having a plurality of dovetail slots formed about a periphery of the shaft supporting at least one annular row of blades, each dovetail slot supporting a blade having an airfoil portion and a dovetail mounting portion received in the dovetail slot wherein a portion of each dovetail slot has an anti-wear coating applied thereto.

In still another aspect, the invention relates to a turbine compressor shaft having a plurality of dovetail slots formed about a periphery of the shaft supporting at least one annular row of blades, each dovetail slot supporting a blade having an airfoil portion and a dovetail mounting portion received in the dovetail slot, wherein each dovetail slot includes a pair of inwardly projecting tangs and a pair of outwardly directed grooves connected by substantially flat transition surfaces; and further wherein a thermoplastic aluminum pigmented coating is applied to said transition surfaces.

In a further aspect, the compressor shaft supports at least three annular rows of blades.

The invention will now be described in connection with the drawings identified below.

DETAILED DESCRIPTION OF THE INVENTION

Figure 1:
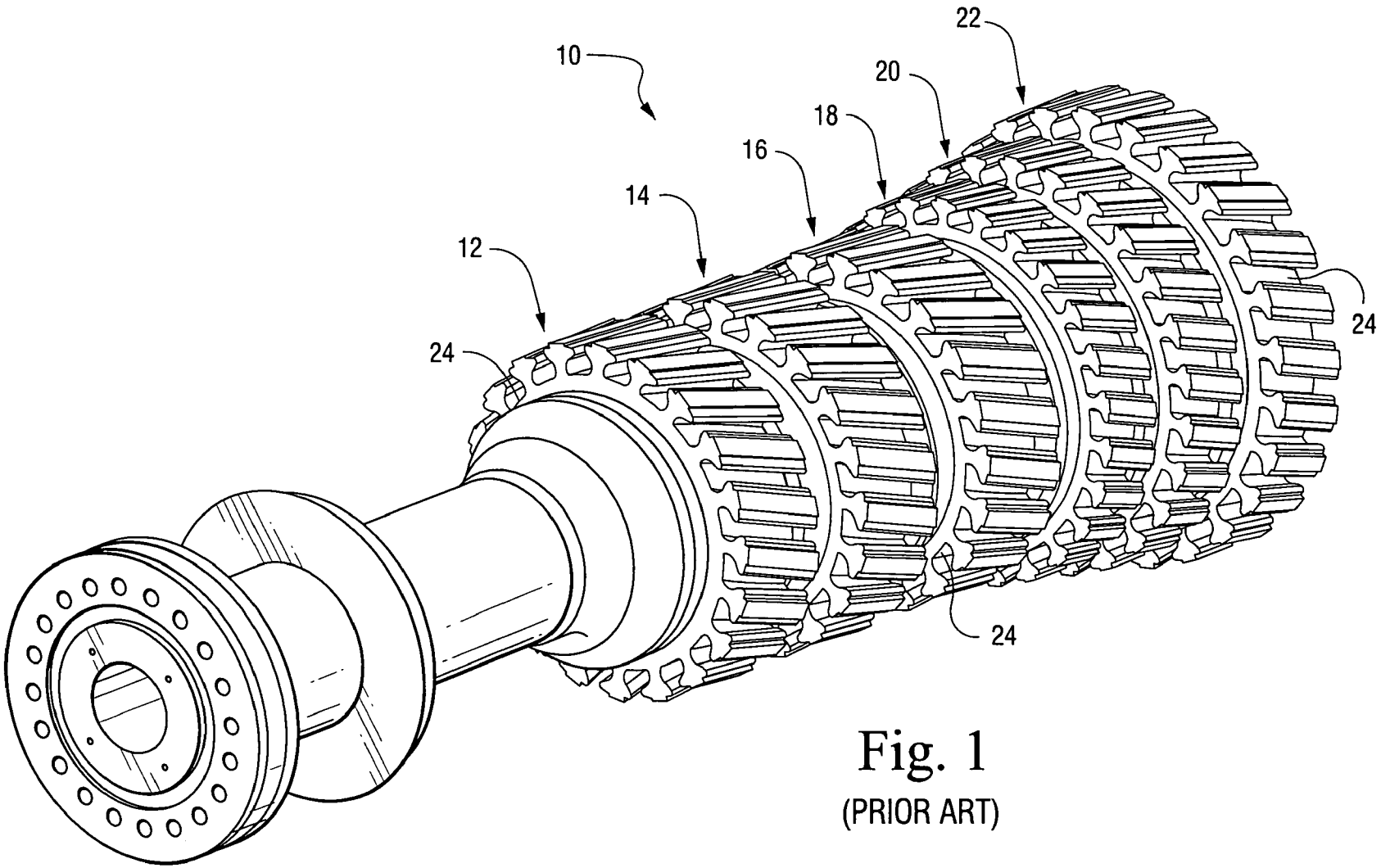
Fig. 1 (PRIOR ART)
FIG. 1 is a perspective view of a conventional compressor forward stub shaft.

FIG. 1 illustrates a conventional compressor forward stub shaft 10 formed with six integral, annular rows of dovetail slots 12, 14, 16, 18, 20 and 22, each slot 24 configured to support a compressor blade having a mating dovetail portion. Each row of blades represents a stage of the compressor stub shaft and, with respect to this invention, it is the first two rows or stages 12 and 14 that are of particular interest.

Figure 2:
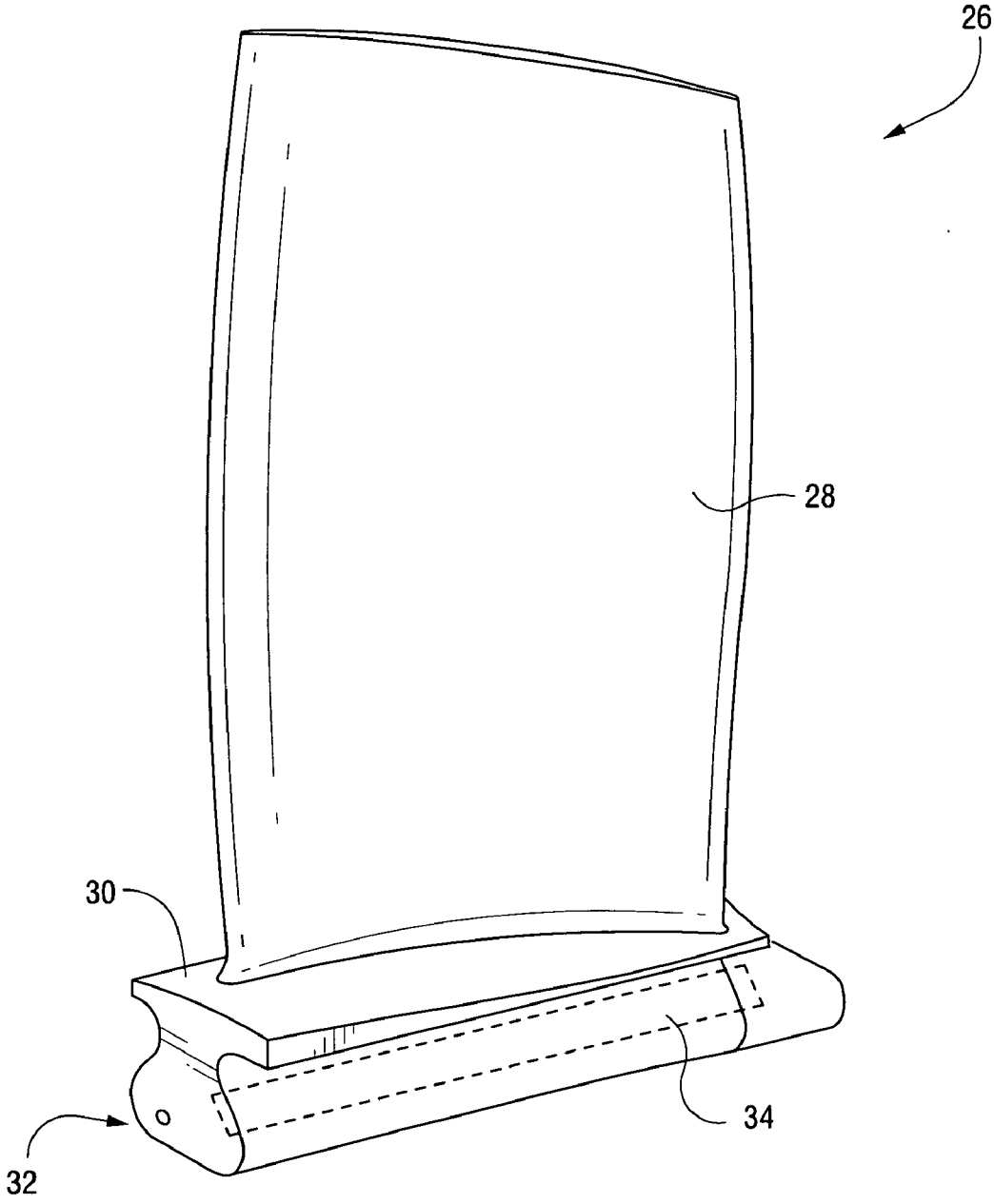
Fig. 2 (PRIOR ART)
FIG. 2 is a perspective view of a conventional compressor blade.

A typical first stage compressor blade 26 is shown in FIG. 2. The blade includes an airfoil 28, platform 30 and dovetail or dovetail mounting portion 32, shaped to be received in a corresponding dovetail slot 24 (FIG. 1). In the past, a wear-resistant coating (shown generally in phantom) has been applied to the surfaces 34 (one shown) on opposite sides of the dovetail 32. As already noted above, however, certain coatings, such as Alumazite ZD, is not compatible with C450 steel alloy material used for the blades 26. As a result, the corrosion and fatigue resistance of the blade can be degraded.

Figure 4:
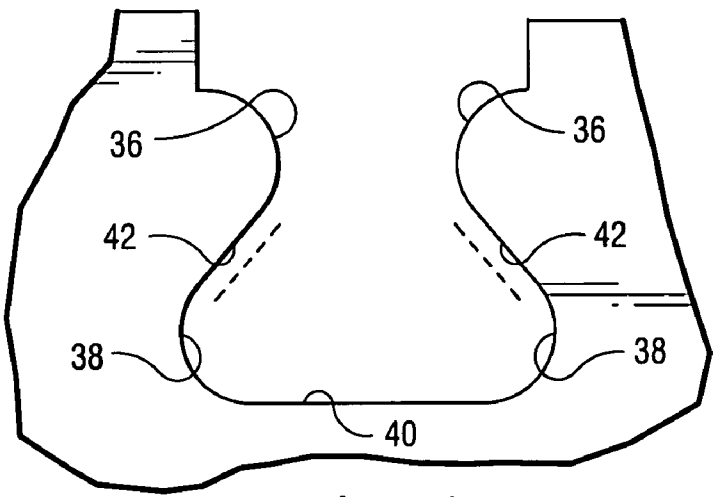
FIG. 4 is a simplified partial end view of a dovetail slot indicating surface areas where a coating has been applied.
Figure 3:
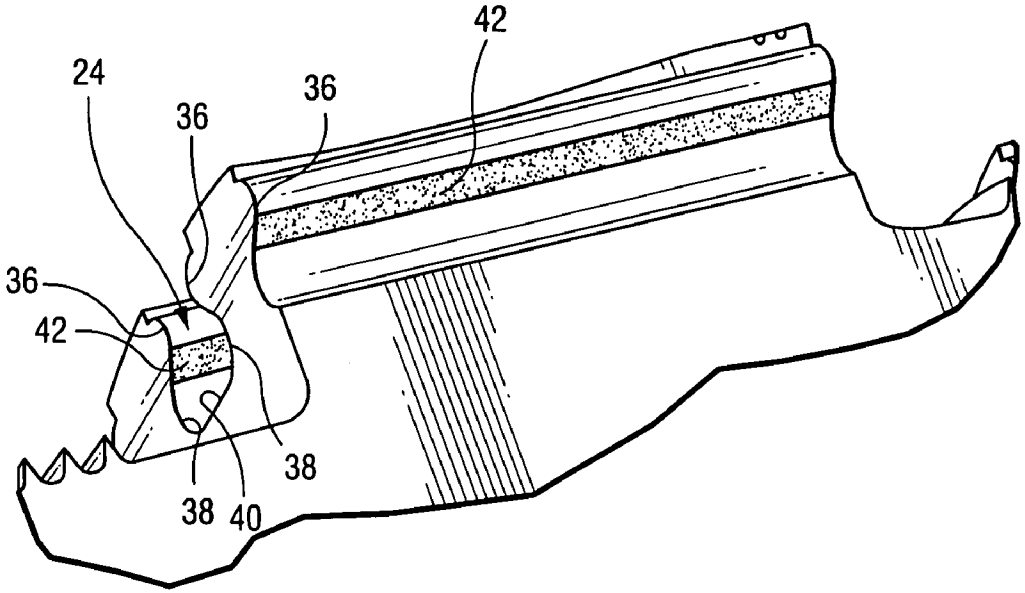
FIG. 3 is an enlarged partial detail of a first compressor stage, taken from FIG. 1, and showing a coating applied to the dovetail slot in accordance with an exemplary embodiment of the invention.

Turning to FIGS. 3 and 4, the first stage 12 of the forward stub shaft 10 is shown partially, but in greater detail. Each dovetail slot 24 is formed with a pair of inwardly directed tangs 36 and a pair of outwardly directed grooves 38, connected by a flat base surface 40. Note that the first dovetail slot 24 in FIG. 3 has been sectioned through the radial centerline of the slot for ease of understanding the location of the wear-resistant coating. In the exemplary embodiment, an anti-wear coating 41 applied over the full axial length of a substantially flat surface 42 that serves as a transition between the convex radius of the dovetail tang 36 and the concave radius of the dovetail groove 38. It will be appreciated that there are two such laterally opposed transition surfaces 42 in each dovetail slot 24 (see FIG. 4), and that each slot 24 about the full 360° extent of the row of slots is similarly coated.

In the exemplary embodiment, for a stub shaft composed of a NiCrMoV alloy, a thermoplastic aluminum-pigmented coating is applied to a thickness of between 0.0008 to 0.0018 inch. One such coating is commercially available under the name Alumazite ZD, manufactured by Tiodize Co., Inc. This coating (or similar suitable coating) prevents galvanic and environmental oxidation, and is compatible with the NiCrMoV dovetail material. The coating may be applied by conventional spray techniques, recognizing that tooling must be adapted to access the underside of the dovetail tangs.

Test results to date confirm that coating the dovetail slots 24 is a feasible technique for avoiding the previously experienced degradation of corrosion fatigue resistance properties of the blade dovetails 32 as described above. For example, an Alumazite ZD-coated NiCrMoV material was exposed to salt fog for 405 hours, and there was no corrosion under the coating with only minor attack at the root where the coating was cut with a knife to expose the material. Wear tests were also conducted between coated NiCrMoV and GT-450, demonstrating no evidence of pitting after 5000 cycles and low friction.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A compressor forward stub shaft comprising a plurality of axially spaced, annular rows of dovetail slots, at least a first and a second of said plurality of rows having dovetail slots coated in part with an anti-wear coating, wherein said stub shaft is composed of a NiCrMoV alloy, and wherein said anti-wear coating comprises a thermoplastic aluminum pigmented coating.

2. The compressor forward stub shaft of claim 1 wherein each dovetail slot includes a pair of inwardly projecting tangs and a pair of outwardly directed grooves connected by a flat base.

3. The compressor forward stub shaft of claim 2 wherein each dovetail slot also includes substantially flat transition surfaces between said pair of tangs and said pair of grooves.

4. The compressor forward stub shaft of claim 3 wherein said anti-wear coating is applied only to said substantially flat transition surfaces.

5. A turbine compressor shaft having a plurality of dovetail slots formed about a periphery of the shaft supporting at least one annular row of blades, each dovetail slot supporting a blade having an airfoil portion and a dovetail mounting portion received in said dovetail slot wherein a portion of each dovetail slot has an anti-wear coating applied thereto, wherein said shaft is composed of a NiCrMoV alloy and said blade is composed of a C450 steel alloy, and wherein said anti-wear coating comprises a thermoplastic aluminum pigmented coating.

6. The turbine compressor shaft of claim 5 wherein each dovetail slot includes a pair of inwardly projecting tangs and a pair of outwardly directed grooves connected by a flat base.

7. The turbine compressor shaft of claim 6 wherein each dovetail slot also includes substantially flat transition surfaces between said pair of tangs and said pair of grooves.

8. The turbine compressor shaft of claim 7 wherein said anti-wear coating is applied only to said substantially flat transition surfaces.

9. The turbine compressor shaft of claim 5 wherein said shaft comprises a compressor forward stub shaft having at least three annular rows of blades wherein at least first and second of said at least three annular rows of blades are mounted in dovetail slots with said anti-wear coating applied thereto.

10. A turbine compressor shaft having a plurality of dovetail slots formed about a periphery of the shaft supporting at least one annular row of blades, each dovetail slot supporting a blade having an airfoil portion and a dovetail mounting portion received in said dovetail slot, wherein each dovetail slot includes a pair of inwardly projecting tangs and a pair of outwardly directed grooves connected by substantially flat transition surfaces; and further wherein a thermoplastic aluminum pigmented coating is applied to said transition surfaces.

11. The turbine compressor shaft of claim 10 wherein said shaft is composed of a NiCrMoV alloy and said blade is composed of a C450 steel alloy.

12. The turbine compressor shaft of claim 10 wherein said thermoplastic aluminum pigmented coating is applied only to said substantially flat transition surfaces.

13. The turbine compressor shaft of claim 10 wherein said shaft comprises a compressor forward stub shaft having at least three annular rows of blades wherein at least first and second of said at least three annular rows of blades are mounted in said dovetail slots with said anti-wear coating applied to said transition surfaces.

* * * * *